US005167328A

United States Patent [19]

Vinson

[11] Patent Number: 5,167,328

[45] Date of Patent: Dec. 1, 1992

[54] ROTARY MICROMETER

[76] Inventor: Paul Vinson, P.O. Box 4020, St. Simon Island, Ga. 31522

[21] Appl. No.: 708,729

[22] Filed: May 31, 1991

[51] Int. Cl.[5] ..... B07L 5/04

[52] U.S. Cl. ..... 209/668; 209/673

[58] Field of Search ..... 209/668, 670, 673

[56] References Cited

U.S. PATENT DOCUMENTS

| | | | |
|---|---|---|---|
| 1,745,318 | 1/1930 | Chapman | 209/668 |
| 2,343,042 | 2/1944 | Barry | 209/668 |
| 2,960,224 | 11/1960 | Cronan | 209/668 |
| 3,260,364 | 7/1966 | England | 209/668 |
| 3,313,410 | 4/1967 | Gardner | 209/668 |
| 3,739,909 | 6/1973 | Garland et al. | 209/668 |
| 3,874,508 | 4/1975 | Cronan | 209/668 |
| 4,172,527 | 10/1979 | Bost | 209/668 |
| 4,436,208 | 3/1984 | Cronan | 209/668 |
| 4,767,010 | 8/1988 | Bost | 209/673 X |
| 4,790,439 | 12/1988 | McIntyre et al. | 209/668 X |

FOREIGN PATENT DOCUMENTS

| | | | |
|---|---|---|---|
| 0631639 | 8/1963 | Belgium | 209/670 |

*Primary Examiner*—Robert P. Olszewski
*Assistant Examiner*—James R. Bidwell
*Attorney, Agent, or Firm*—Warren F. B. Lindsley

[57] ABSTRACT

A classifying machine for sizing articles, separating the articles so sized and delivering those within given size limits to particular bins having a pair of juxtapositioned rollers raised at their feed ends so that they move in part under the force of gravity to their discharge ends. The rollers are each individually adjustable at different ends to taper outwardly of each other from the feed end to the discharge end so that the smallest selected sizes of the articles drop between the rollers in a collection bin at the feed end and the articles of the largest size are discharged at or near the discharge end of the rollers.

3 Claims, 5 Drawing Sheets

ROTARY MICROMETER

BACKGROUND OF THE INVENTION

This invention relates to classifying machines for sizing articles and separating the articles as sized and more particularly to rotary micrometers which measure the exterior shapes of objects having a constant outer configuration.

In the machine disclosed classifying is accomplished by the use of a pair of rollers the axes of which taper outwardly from each other so that the smallest articles drop between the rollers near the feed end of the machine.

DESCRIPTION OF THE PRIOR ART

Prior art classifying machines have used rollers which are mounted on their axes so that it is necessary for three dimensions to be as accurate as possible, namely centerline straightness, surface circularity and surface straightness. As a consequence, it is important that such rollers be accurately machined and checked periodically to be certain that the accuracy is maintained.

U.S. Pat. No. 3,874,508 discloses a classifying machine for sizing articles, separating the articles so sized and delivering these within given size limits to particular bins. The machine discloses a pair of rollers mounted for support on open face bearings with the rollers raised on the feed end so that the parts move in part under the action of gravity toward the discharge end. The rollers' axes taper outwardly from each other from the feed and toward the discharge end so that the smallest sizes of the articles drop between the rollers into a collection bin at the nearest feed end and the articles of the largest size are discharged at or near the discharged end.

This invention is an improvement over the above identified patent.

SUMMARY OF THE INVENTION

The inspection of manufactured work pieces is a constant and continuing project and usually involves an inspection procedure following the discharge of the work pieces from a rotary or vibratory hopper. These work pieces may have any shape such as spherical, cylindrical, square, tubular or rectangular, providing it has a constant outer contour that can pass between two gauging surfaces.

These gauging surfaces may be a pair of counter rotating cylinders defining between them a tapered rotating opening. As the taper increases, the pieces being checked along the tapered opening drop through the opening between the cylinders when the opening is equal to or slightly larger than the contour of the work pieces being gauged.

Thus, this system may check for minimum and maximum diameters as the taper increases, for example, from 0.0128 inches in diameter to 0.0150 inches in diameter in 0.0002 increments.

It is, therefore, one object of this invention to provide an improved classifying machine which maintains its accuracy while being simple to operate and maintain.

Another object of this invention is to provide an improved rotary micrometer.

A further object of this invention is to provide an improved rotary micrometer which may be adjusted to gauge a variety of work pieces of different geometrical configurations in small increments of size.

A still further object of this invention is to provide an improved means for controlling and guiding the work pieces along a pair of cooperating counter rotating gauging cylinders.

A further object of this invention is to provide a rotary micrometer employing a pair of controlled counter rotating cylinders that define between them a controllable graduating increasing tapered opening through which the work pieces pass for measuring work pieces of a given cylindrical configuration.

A still further object of this invention is to employ shredder, positioner and/or stripper lines to oppose force, friction or inertia of the rotating rollers of a rotary micrometer.

Accordingly, this invention comprises a classifying machine having a pair of oppositely rotating rollers spaced outwardly from each other and journalled in bearings at the feed and discharge ends of the machine. Due to the manner in which the rollers are supported, the two inwardly facing portions of the rollers are free of obstructions throughout their length. This facilitates the passage of the article being classified and enables the use of substantially the total roller length.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Referring more particularly to the drawings by characters of reference, FIGS. 1–7 disclose a rotary micrometer 10 designed to gauge or inspect a great variety of forms or shapes at a high production rate.

Figure 5:
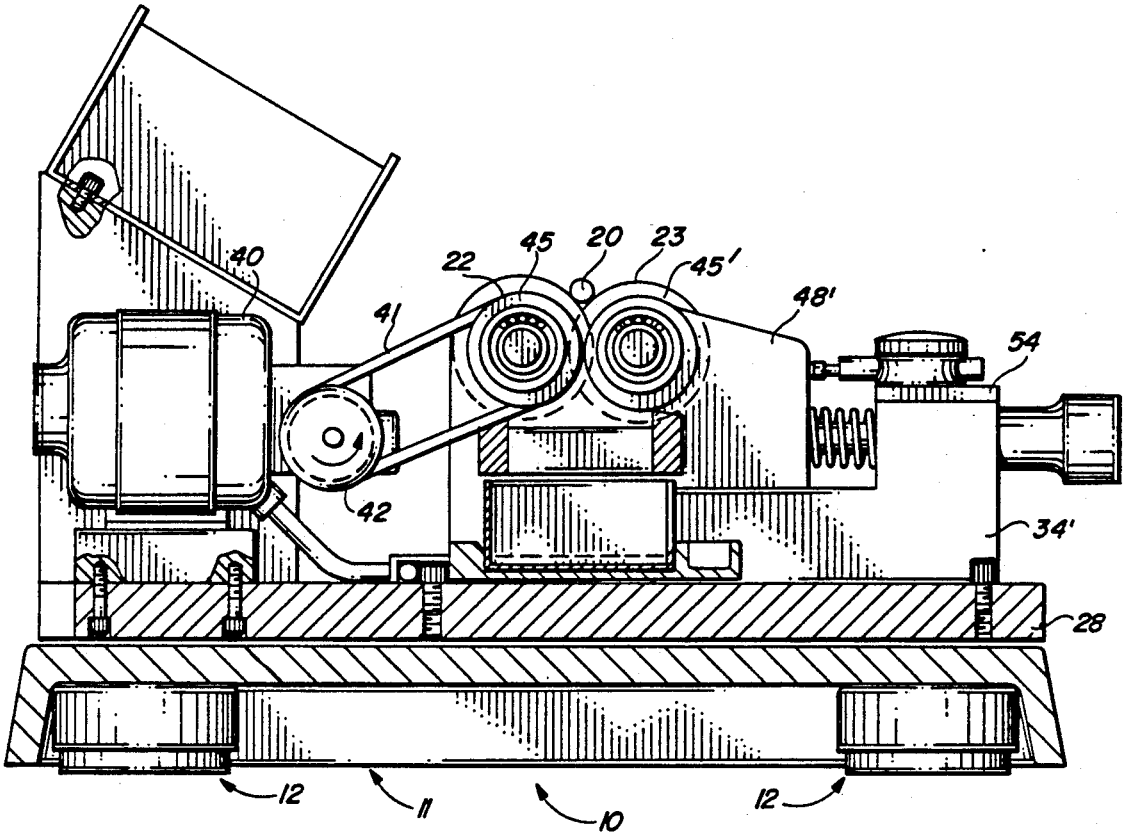
FIG. 5 is a cross sectional view of FIG. 1 taken along the line 5—5.

The rotary micrometer comprises a platform 11 which is supported on four anti-vibration pads 12 shown in FIG. 5. A vibratory or rotary hopper or bowl 13 which may be used with certain types of work pieces for inspection and gauging, is mounted on platform 11 so as to rotary feed the work pieces to the inspection and gauging portion of the micrometer.

If so desired the micrometer may be fitted with other tooling and tracks for handling a large variety of shapes and sizes of the work pieces.

Figure 4:
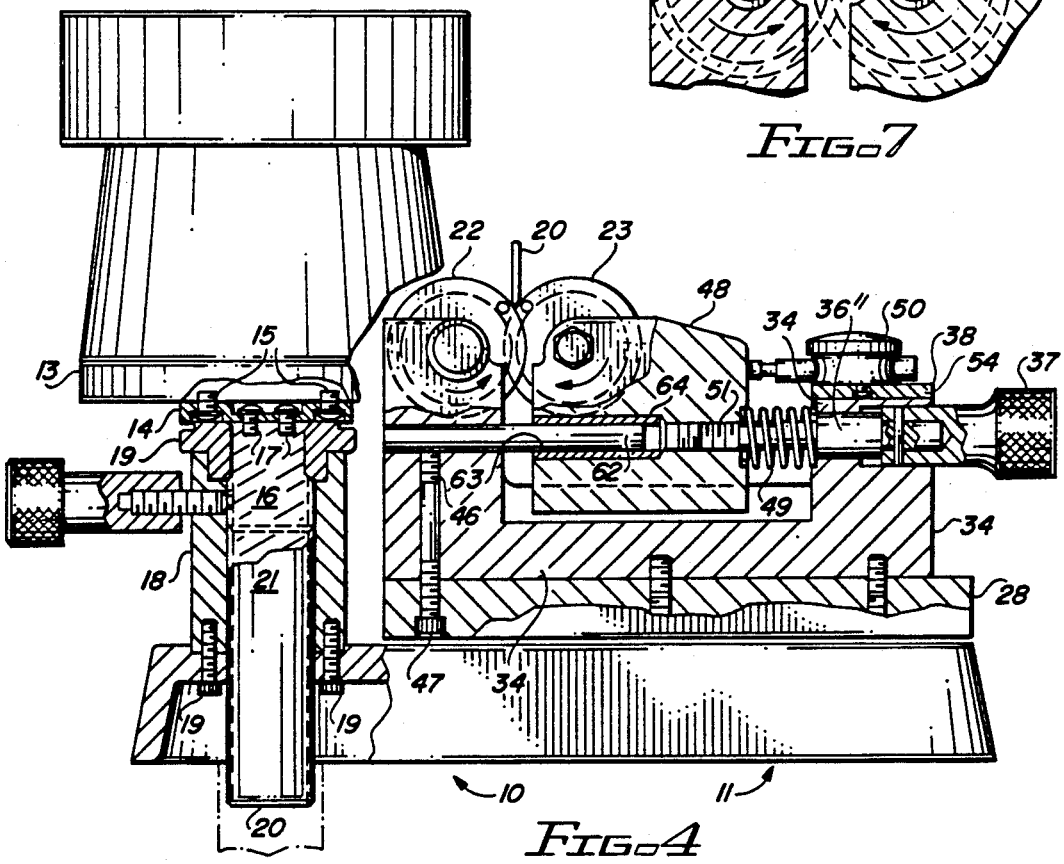
FIG. 4 is a cross sectional view of FIG. 1 taken along the line 4—4.

The hopper or bowl 13 as shown in FIG. 4, is mounted on a plate 14 which is attached by bolts 15 to its bottom and to a cylinder 16 by a pair of bolts 17. Cylinder or jack screw 16 is slidably mounted in a sleeve or housing 18 for movement axially thereof. A nut 19 is threadedly attached to cylinder 16 for movement of cylinder 16 axially in housing or cylinder 18 which causes vertical displacement of bowl 13 relative to platform 11.

A feeding tube 20 is provided for transferring the work pieces identified by arrows 21 to the upstream center area of a pair of gauging rollers 22 and 23.

Figure 1:
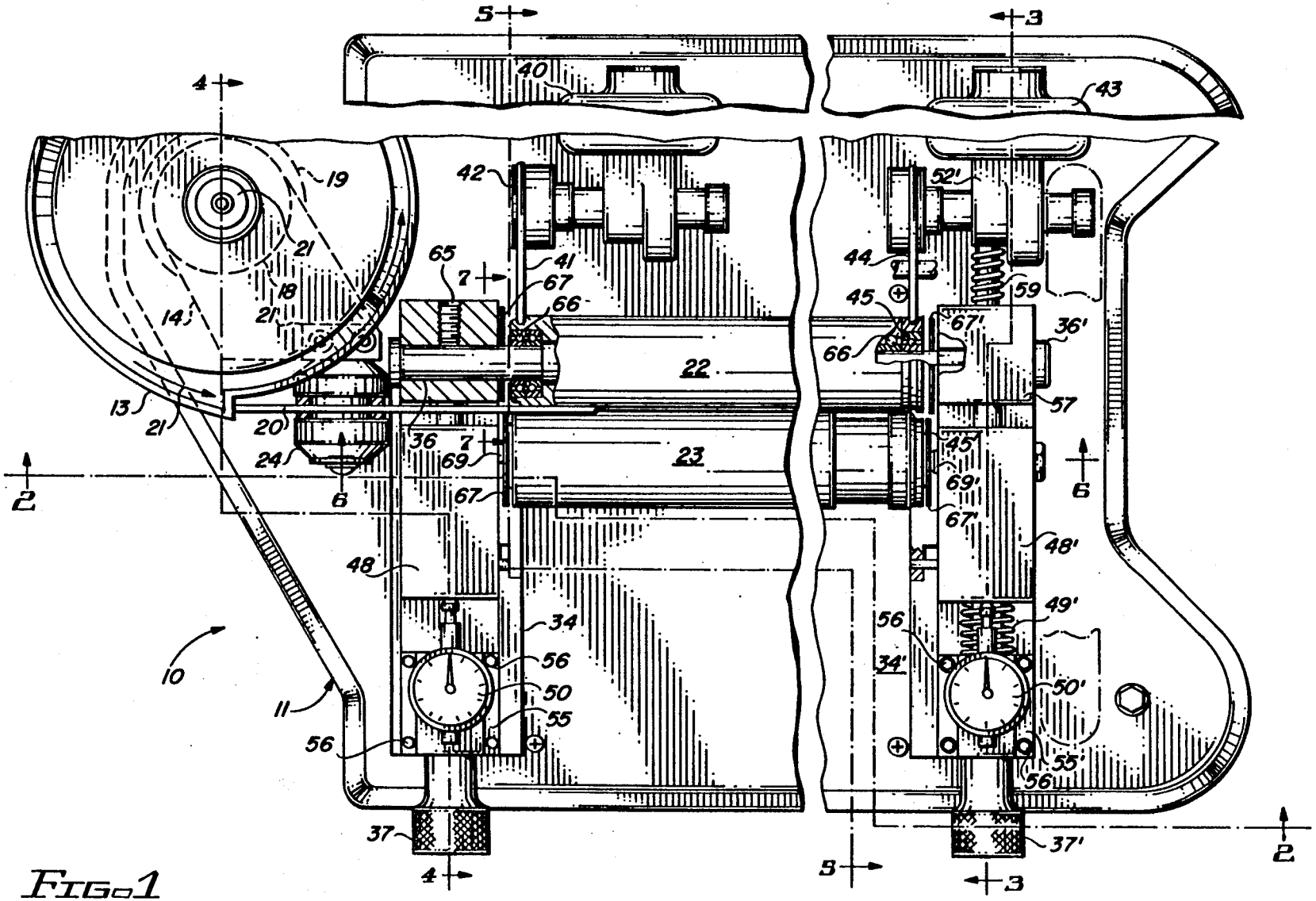
FIG. 1 is a partial plan view of a rotary micrometer and embodying the invention.
Figure 2:
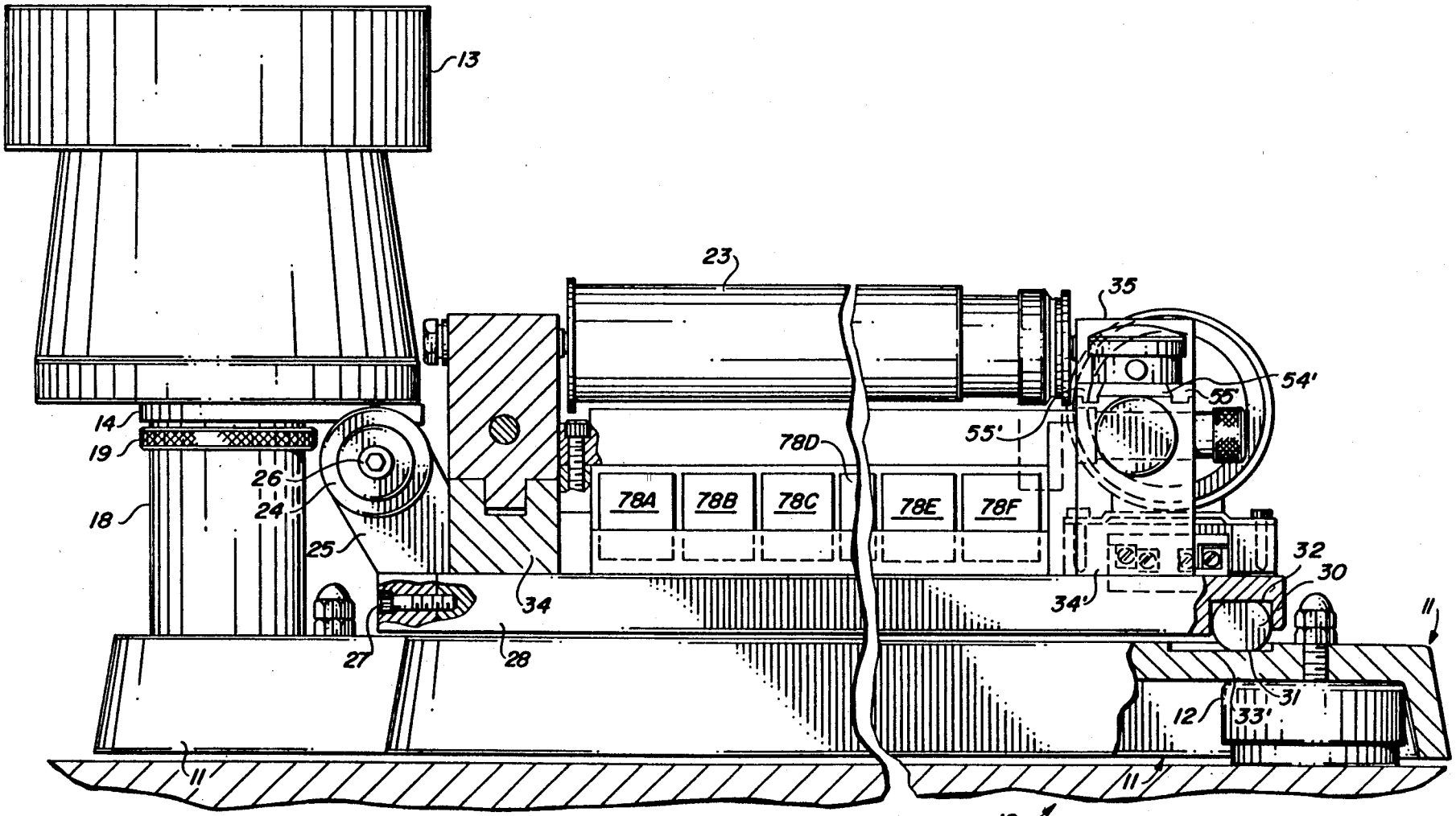
FIG. 2 is a cross sectional view of FIG. 1 taken along the line 2—2.

As shown in FIGS. 1 and 2, a pivotal housing 24 is secured to plate 14 and is provided with a bracket 25 that is rotatably mounted on a bolt 26 forming a part of housing 24. Bracket 25 is attached by bolt 27 to a subbase 28 at one end thereof. As seen in FIG. 2, the other end of subbase 28 is provided with cylinder 30 extending laterally thereacross which is provided with a pair of parallelly arranged flat surfaces 31, 32. Cylinder 30 slides in a trough 33 formed in platform 11 when the bowl is vertically moved by nut 19 causing pivotal movement of subbase 28.

The subbase 28 supports and journals the pair of gauging rollers 22 and 23 and may be moved at the left end, as shown in FIG. 2, relative to the right end thereof by turning the adjustment nut 19 as heretofore explained. Since the raising and lowering of the subbase 28 takes place at the left end of the subbase, the right end of the subbase and cylinder 30 secured thereto by gravity slides along trough 33.

The purpose of the pivotal movement of subbase 28 is to provide gravity feed of the work pieces 21 from left to right along the space between rollers 22 and 23. The parts are moved left to right along the top of and inbetween the counter rotating rollers 22 and 23.

As noted from FIGS. 1 and 4 of the drawings, the only functional items mounted or resting on the top of platform 11 are housing 18, pivotal housing 24 and cylinder 30, as seen in FIG. 2, which rests by weight alone on platform 11. All other items with the exception of vibrator pads 12 of rotary micrometer 10 are directly or indirectly mounted on subbase 28.

Shown on top of and at either end of subbase 28 are two guide blocks 34, 34' best seen in FIGS. 2–5. The purpose of these blocks is each to provide a passageway for blocks 48, 48' and shafts connecting blocks 48, 48' to blocks 34, 34' forming a part of the roller adjustment means for roller 23 and fixed position roller 22.

As shown in FIGS. 1, 3, 4 and 5 rollers 22 and 23 are journaled one end in each of blocks 34, 34' with roller 22 being driven by an electric motor means 40 through a belt drive 41 and drive pulley 42 mounted at the left end of roller 22, as shown in FIG. 1, and motor means 43 driving roller 23 in an opposite direction to roller 22 through a belt drive 44, free wheeling pulley 45 on the shaft of roller 22 and drive pulley 45' machined on the end of roller 23 opposite to the driving end of roller 22.

Figure 3:
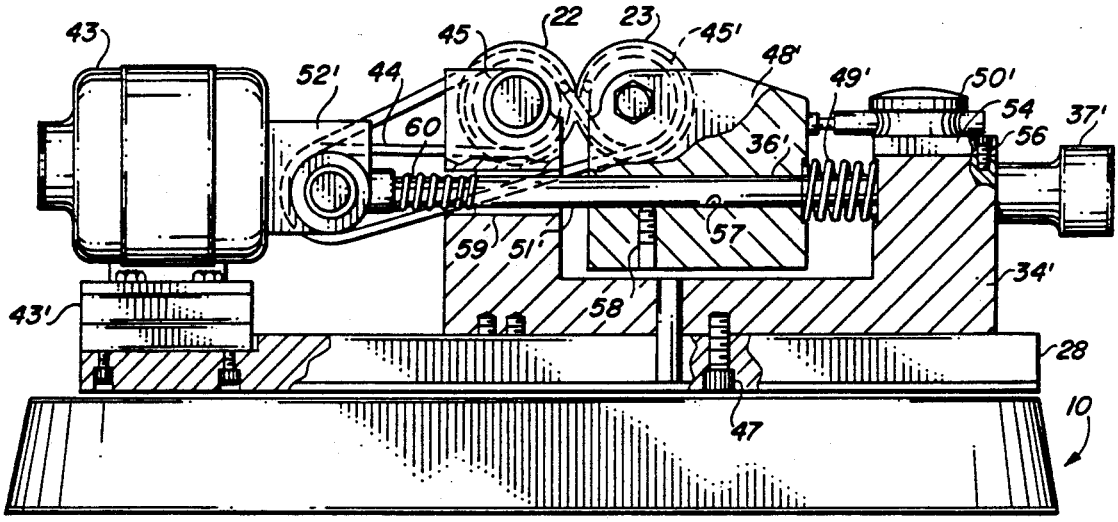
FIG. 3 is a cross sectional view of FIG. 1 taken along the line 3—3.

Blocks 34, 34' are secured to subbase 28 by bolts 47, 47' arranged in the rear end of platform 28, as shown in FIGS. 3 and 4. Each block is similar except for the different extensions of their shafts 36 and 36'.

As noted from FIG. 1, roller 22 is rotated from its left end by belt 41 driven by motor and driver 42 with its left end journaled on shaft 36 in a free wheeling manner.

Blocks 34, 34' journal roller 22 in a given position while roller 23 mounted in blocks 48, 48' between blocks 34, 34' is adjustably positioned so as to move to and from roller 22 in an angular relationship thereto. The left end of roller 23 with reference to roller 22 may be positioned at a given distance from roller 22 while the opposite end of roller 23 may be moved a greater distance from roller 22 thus providing an adjustable triangular space between the rollers for gauging purposes.

This adjustment of the position of rollers 22 and 23 relative to each other is accomplished by the movement of blocks 48, 48' in and relative to blocks 34, 34' respectively.

As shown in FIGS. 1 and 4 block 48 is moved in block 34 by rotation of knob 37 which causes block 48 to move along shaft 36'' which is threaded thereto. This movement of block 48 which supports and journals the left end of roller 23 as shown in FIG. 1 positions roller 23 relative to roller 22 at that end of the micrometer. The other end of roller 23 also may be moved relative to roller 22 by the same type of relative movement of block 48' in block 34' by knob 37' independently of the other end of roller 23 as shown in FIG. 3. Thus, two motors and their belt arrangements are provided for relative movement of roller 23 relative to roller 22.

FIG. 3 illustrates the geometrical configuration of the drive belt arrangement for moving the right end of roller 23 relative to roller 22. Blocks 48 and 48' may be moved by motors 40 and 43 to position the ends of roller 23 in a fine adjustment manner for gauging purposes when associated with roller 22. The motors do nothing but rotate rollers 22 and 23 in opposite directions. Motor 43 and block 48' containing ball pivot for roller 23 are adjusted "en masse" by adjusting screw 37. Motor 43 is mounted on a ball slide 43 attached to the subbase. Shaft 51 is locked in block 48' by screw 58. Belt 44 and spring 60 work against each other and hold motor 43 against shaft 51. The total assembly moves by adjusting screw 37.

The disclosed means for adjustably positioning the ends of roller 23 relative to roller 22 makes it possible to provide two different thread pitches of shafts 36, 36' relative to their threaded association with blocks 48, 48', respectively. This makes it possible to provide fine and sensitive adjustments of the gauging parts one independent of the other. In special situations, the exact thread ratio may be varied with the amount of change registered on indicators 50, 50'.

These ratios can be chosen to suit the desired conditions or ranges involved. A slight increment of movement of blocks 48, 48' by an easily felt hand movement of the adjustment knobs 37, 37' can provide gauge adjustments in the areas of millionths of an inch. Also assisting in the accuracy of the roller adjustment means are the compression springs 49, 49'. These springs have a two fold purpose. First, they provide a desired amount of drag on the axial adjustment of roller 23 and secondly they provide a sufficient amount of constant axial force between blocks 34 and 48 and blocks 34' and 48' to minimize backlash and to maintain the given setting of roller 23.

As noted from FIGS. 1 and 3, shaft 51' extends axially from block 48' against the gear box housing 52' of motor 43.

With reference to FIGS. 1–4, indicators 50, 50' are both affixed and adjustable front to rear and by bracket plates 54, 54' which are guided between locking gibs 55, 55'. In the process of setting up this adjustment means off of the rotary micrometer the plates 54, 54' are secured to the back of the indicator and guided between the two loosely held gibs 55, 55'. The indicators 50, 50' and attached bracket plates 54, 54' are advanced forward until the indicator tips contact the rear of blocks 48, 48' respectively as shown in FIGS. 3 and 4 and until the desired range on the indicator face has been reached.

The locking gibs 55, 55' are then tightened firmly to the top of block 48, 48' by screws 56.

As shown in FIG. 3, shaft 51' is affixed in place in hole 57 at the rear of block 48' by set screw 58. This hole for shaft 51' is in axial alignment with the threaded end of shaft 36'. Shaft 51' then passes through a guide bushing 59, compression spring 60 and is implanted against motor gear box 52' with spring 60 compensating for the tension on a belt 61.

In FIG. 4, shaft 62 is affixed in a hole 63 by set screw 46 and passes into a guide bushing 64 imbedded into block 48. Shaft 62 is axially in line with shaft 51 which is threadedly attached to block 48.

It should be noted that blocks 48 and 48' are similarly aligned with their associated shafts in a horizontal manner to maintain an accurate and adjustable association between rollers 22 and 23.

Roller shafts 36, 36' are rigidly held in place in upright portions of block 48 and 48' by set screws 65 one of which is shown in FIG. 1 with shafts 36, 36' being journaled in both ends of roller 22 by suitable ball bearing 66. Plates 67 and 67' surrounding the reduced terminal ends of roller 22 and are secured to roller shafts 36, 36', as shown, for aligning shredder, positioner or stripper lines hereinafter explained.

The combination of the ball bearings at each end of the shaft provides an accurate alignment yet allowing for the free wheeling for idler pulley 45.

Motors 40 and 43 and their associated gear boxes drive rollers 22 and 23 individually and at variable speeds with motor 40 driving roller 22 through belt 41 and pulley or sleeve 42.

From FIGS. 1 and 3, it is noted that roller 23 is driven by a variable drive system. This is accomplished by motor 43, gear box 52', pulley 45' and flexible belt drive 44. This arrangement provides for individual rotation of roller 23 and speed control and flexible spacing between roller 22 and roller 23.

As shown in FIG. 3, belt 44 passes through a groove under idler pulley 45, rotating belt grooved roller 23 in a clockwise rotation. Although pulley 45, as seen in FIG. 3, is rotating in the opposite counter clockwise direction as pulley 45', it nevertheless is free wheeling from roller 22. As seen, belt 44 passes up and over the driven pulley 45' on roller 23 and rotates roller 23 in a clockwise direction.

Figure 6:
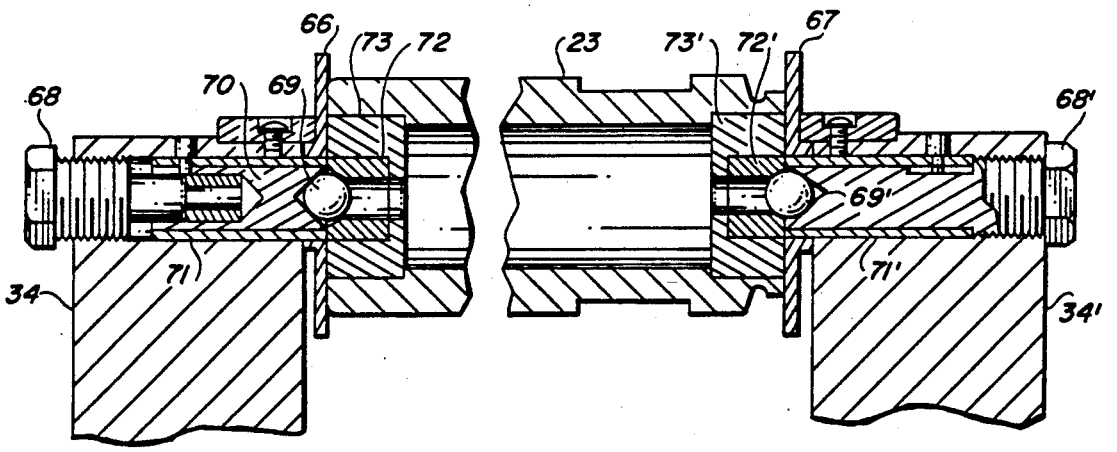
FIG. 6 is a cross sectional view of FIG. 1 taken along the line 6—6.

FIG. 6 is a partial enlarged cross sectional view of roller 23 taken along the line 6—6 of FIG. 1. Starting from the left nut screw 68 is threadedly connected to block 34' and adjusts the load on a ball 69 through a cylindrical spacer 70 mounted in a bushing 71.

Ball 69 is set in seats formed in the end of spacer 70 and in the juxtapositioned associated end of a bushing 72 axially mounted in another bushing 73 seated in the end of roller 23, as shown in FIG. 6.

The other end of roller 23 is similarly mounted with like elements provided with a prime number.

Figure 7:
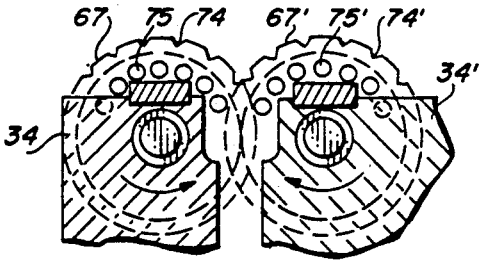
FIG. 7 is a cross sectional view of FIG. 1 taken along the line 7—7.

FIG. 7 is a cross sectional view of FIG. 1 taken along the line 7—7 looking in the direction of the arrows showing the shape of plates 67 at one end of rollers 22 and 23 and plates 67' at the other ends of rollers 22 and 23. Each plate is provided with a plurality of grooves 74, 74' along at least a part of its periphery and each with a plurality of holes or apertures 75, 75' extending therethrough in similar arcs about their centers.

Plates are provided at each end of rollers 22 and 23 for maintaining the parts being gauged on top of the rollers and preventing them from adhering to the gauging rollers 22, 23.

Figure 8:
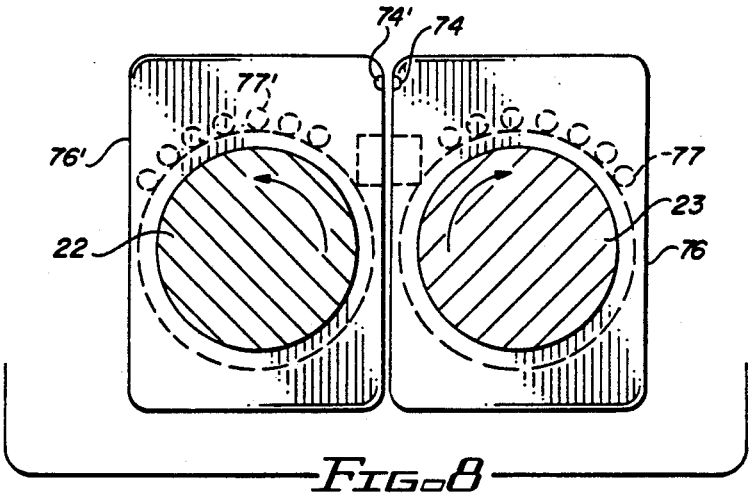
FIG. 8 is a modification of the guide plates for the guiding wires shown in FIG. 7.

FIG. 8 illustrates a further modification of plates 67, 67' shown in FIG. 7 which are shown as rectangular shaped plates 76, 76' having spacedly positioned holes or apertures 77, 77' spacedly arranged in an arc around the center of the axis of the associated rollers 22 and 23.

FIGS. 9A-9F illustrate the rotary micrometer set up for checking various shapes of work pieces.

In FIG. 9, a round item or work piece 21 is being checked for a proper shape and size with it following through into one of a plurality of bins 78A through 78E arranged below the rollers 22 and 23 as shown in FIG. 2.

Guide lines 79 are shown in FIGS. 9A-9F which extend between the two ends of each roller and are tied thereto by use of the grooves and holes in each set of plates 76—76' for stripping or retaining each part or work piece on top of the roller until they fall into one of bins 78A-78F below the rollers as shown in FIG. 2.

Figure 9A:
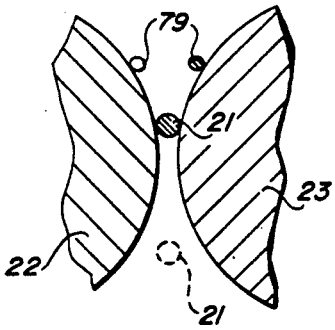
FIGS. 9A–9F illustrate various shaped work pieces being gauged together with the guiding wires shown in FIG. 7.
Figure 9B:
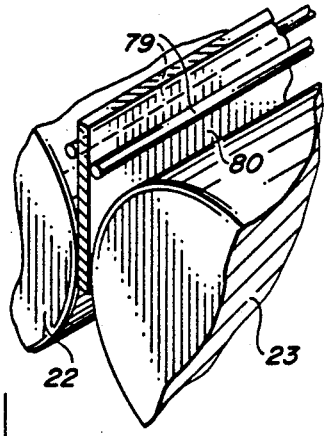

FIG. 9B illustrates a part 80 being gauged by rollers 22 and 23 with guide lines 79 retaining part 80 on the rollers.

Figure 9C:
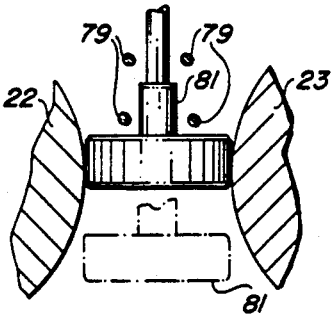

FIG. 9C shows a further part 81 being gauged by rollers 22 and 23 with two sets of guide lines 79 being tied to a different set of holes and grooves in plates 76.

Figure 9D:
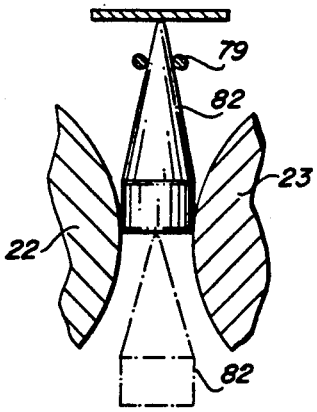
Figure 9E:
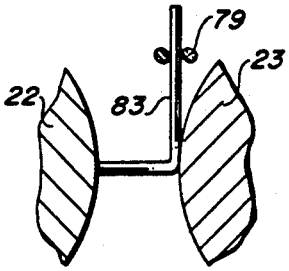
Figure 9F:
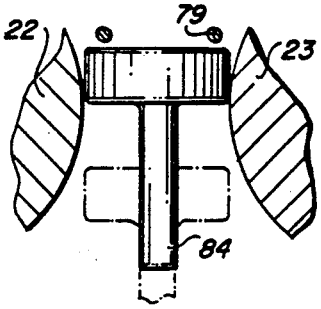

FIGS. 9D through 9F show parts 83-84 being gauged by rollers 22 and 23 with guide lines 79 being used to maintain the parts in place inbetween rollers 22 and 23.

Although but a few embodiments of the present invention have been illustrated and described, it will be apparent to those skilled in the art that various changes and modifications may be made therein without departing from the spirit of the invention or from the scope of the appended claims.

What is claimed is:

1. In a classifying machine for sizing articles and separating the articles so sized in a predetermined pattern having a feed end and a discharge end, a pair of rollers higher at the feed end than at the discharge end and spaced with respect to each other, and a pair of drive means one for each roller for rotating the rollers in opposite directions, the improvement comprising:

four pairs of bearings mounted at the ends of the rollers, each such pair supporting different ends of one of said rollers, a first means for adjustably mounting the feed end of one of said rollers relative to the feed end of the other of said rollers, a second means independent of said first means for adjustably mounting the discharge end of said one of said rollers relative to the discharge end of said other of said rollers, a pair of drive pulleys one mounted at the feed end of one of said rollers and the other at the discharge end of the other of said rollers, each of the drive pulleys being rotated by a different one of the drive means so that the rollers are rotated in opposite directions, and two of said bearings for said one of said rollers being movable in response to forces applied thereto by said other of said rollers.

2. In a classifying machine for sizing articles and separating the articles so sized in a predetermined pattern having a feed end and a discharge end, a pair of rollers higher at the feed end than at the discharge end and spaced with respect to each other, and a pair of drive means one for each roller for rotating the rollers in opposite directions, the improvement comprising:

four pairs of bearings mounted at the ends of the rollers, each such pair supporting different ends of one of said rollers, a first means for adjustably mounting the feed end of one of said rollers relative to the feed end of the other of said rollers, a second means independent of said first means for adjustably mounting the discharge end of said one of said rollers relative to the discharge end of said other of said rollers, a pair of drive pulleys one mounted at the feed end of one of said rollers and the other at the discharge end of the other of said rollers, each of the drive pulleys being rotated by a different one of the drive means so that the rollers are rotated in opposite directions, and guiding means mounted to extend between ends of each of said rollers for stripping the articles being sized from said rollers, said guiding means each comprising a guide wire.

3. The classifying machine set forth in claim 2 wherein:

said guiding means further comprises plate means fixedly mounted one at each end of each of said rollers to which one end of said guide wire is attached.

* * * * *